United States Patent [19]

Globus

[11] 4,120,777

[45] Oct. 17, 1978

[54] PROCESS FOR RECOVERY OF BITUMINOUS MATERIAL FROM TAR SANDS

[75] Inventor: Alfred R. Globus, Bayside, N.Y.

[73] Assignee: Guardian Chemical Corporation, Hauppauge, N.Y.

[21] Appl. No.: 704,843

[22] Filed: Jul. 13, 1976

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS 3,542,666 11/1970 Simpson ..... 208/11 LE 3,623,971 11/1971 Bowman ..... 208/11 LE

FOREIGN PATENT DOCUMENTS 638,886 3/1962 Canada ..... 208/11 LE

*Primary Examiner*—Delbert E. Gantz
*Assistant Examiner*—James W. Hellwege

[57] ABSTRACT

A process for the recovery of bituminous tar like materials from tar sands containing the same; the process includes mixing the tar sands with water, mildly heating the same in the presence of an alkali metal bicarbonate, gently mixing the mixture and while the mixture is warm, removing the recovered bituminous materials therefrom.

16 Claims, No Drawings

PROCESS FOR RECOVERY OF BITUMINOUS MATERIAL FROM TAR SANDS

BACKGROUND OF THE INVENTION

This invention relates to the recovery of bituminous products from sand containing the same. More particularly, the process provides a mechanism for recovering the bituminous matter with a minimum of chemical processing, chemical reactants and with a maximum of safety and non-polluting factors relative to the environment.

The advent of the third quarter of the twentieth century brought with it the realization that there exists a finite quantity of energy sources and that the same can no longer be wasted and that new and additional sources as well as methods must be developed for extraction of the same from the earth.

SUMMARY OF THE INVENTION

It is accordingly an object of the instant invention to provide for a new and improved process for recovering bituminous materials from sand.

It is another object to provide for a process that is environmentally acceptable.

It is another object to provide for a process that may be carried out with a minimum of processing equipment and apparatus.

These and other objects and advantages of the invention will become more apparent from a consideration of the following detailed disclosure and claims.

Broadly speaking, the instant invention includes the provision of a process for the recovery of bituminous matter from sand, comprising admixing the sand with water and an alkali or alkaline earth metal bicarbonate salt, mixing the slurry thus produced and thereafter withdrawing the bituminous material extracted from the sand.

DETAILED DESCRIPTION

The process contemplated herein is most prefarably suited to the removal of bituminous matter, more commonly known as tar from certain types of sand generally found in Utah and Alberta, Canada, and etc. The process parameters include combining about 3 to 0.5, preferably about 2 to 1 by volume, water to the sand to be washed. The sand will ordinarily contain about 2 to 20%, preferably about 6–15% bituminous matter, plus or minus about 2 to 5% at either extreme. To the slurry containing the water and sand there is added about 0.5 to 5% by weight, preferably about 1½ to 3% of an alkali or alkaline earth metal bicarbonate. Expressed another way, about 1/32 to 1 lbs. metal salt per 1000 to 3000 lbs. sand, preferably about 1/16–¾ lbs. metal salt to each 1500–2500 lbs. of sand to be treated. Generally, the alkali metal salt is employed, preferably the alkali metal bicarbonate, most preferably sodium or potassium, with the potassium metal salt being preferred. The water should be heated to about 70° to 120° F., preferably about 85° to 100° F. prior to the addition of the metal salt and sand thereto. To the slurry containing water, sand and metal salt, there is preferably applied an external source that causes the same to mix together through rotation or tumbling although motion which causes the creation of a vortex should be avoided. The gentle mixing may be carried out in any suitable vessel, such as a drum, tank or the like, the specific vessel not being essentially critical to the attainment of the invention. A mild exothermic reaction is initiated by the mixing of the slurry ingredients, which reaction generally generates a temperature of about 95° to 150° F., preferably about 100° to 130° F., due in part, it is believed, to the oxidation of volatile components of the tar and sand and from the splitting off of carbon dioxide gas from the metal salt. The mixing procedure should be carried out for about 15 to 90 minutes, preferably about 25 to 60 minutes, the period of time being circumscribed by the amount of reactants, degree of mixing and level of heat generated. If desired, external heat may be applied to the vessel to accelerate the extraction. Generally, apparatus choice will be the controlling factor in this particular stage of the reaction. The reaction or extraction procedure is generally considered substantially completed when the exothermic reaction subsides below the peak temperature, at which point the reaction vessel will contain three distinct layers of product. The layers are tar or bituminous material at the top; water below and at the bottom the treated sand having had the product of layer one removed therefrom. It is believed that the tar layer rises to the top because of the evolution of carbon dioxide which percolates through the tar and thereby reduces its specific gravity from about 1.02–1.04 to about 0.95–0.92, which is less than that of water. The extraction of the tar from the vessel should be carried out while the carbon dioxide is still being generated, thereby ensuring that the tar layer will remain at the top and not form an emulsified mixture with the water or sink to the bottom. The foregoing is effected by carrying out the extraction of the tar from the vessel while still warm or by maintaining an external source of heat thereto. The separation of the ternary mixture is carried out by preferably removing the water to a storage tank (or the same can be disposed of), the sand is washed with water to recover any residual or unreacted metal salt therefrom. In the separation procedure it is preferable that no emulsification of the ternary mixture takes place, which emulsification would adversely affect the process. It may in certain instances be desirable to treat the sand with a non-foaming wetting agent to accelerate the treatment thereof. Wetting agents of the type commonly referred to as neutral are preferred, for example those conventionally designated as non-ionic synthetic organic detergents generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyetheneoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, for example, nonylphenol condensed with 9 moles of ethylene oxide, dodecyl phenol condensed with 15 moles of ethylene and dinonyl phenol condensed with 15 moles of ethylene oxide. Condensation products of the corresponding alkyl thiophenols with 5 to 30 moles of ethylene oxide are also suitable.

Still other suitable nonionics are the polyoxyethylene polyoxpropylene adducts of 1-butanol. The hydrophobe of these anionics has a minimum molecular weight of 1,000 and consists of an aliphatic monohydric alcohol containing from 1 to 8 carbon atoms to which is attached a heteric chain of oxyethylene and oxypropylene. The weight ratio of oxypropylene to oxyethylene covers the range of 95:5 to 85.15. Attached to this is the hydrophilic polyoxyethylene chain which is from 44.4 to 54.6 of the total molecular weight.

Also included in the nonionic detergent class are the condensation products of a higher alcohol containing about 8 to 18 carbon atoms in a straight or branched-chain configuration condensed with about 5 to 30 moles of ethylene oxide, for example, lauryl-myristyl alcohol condensed with about 16 moles of ethylene oxide.

A particularly useful group of nonionics is marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4,000 and preferably 1,200 to 2,500. The addition of polyoxyethylene radicals to the hydrophobic portion tends to increase the solubility of the molecule as a whole. The molecular weight of the block polymers varies from 1,000 to 15,000, and the polyethylene oxide content may comprise 20% to 80% by weight.

Zwitterionic detergents such as the betaines and sulfobetaines having the following formula are also useful:

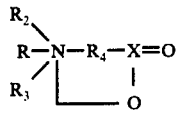

wherein R is an alkyl group contaning about 8 to 18 carbon atoms, $R_2$ and $R_3$ are each in alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:o, the detergent is called a sulfobetaine or sultaine. Preferred betaine and sulfobetaine detergents are 1-(lauryl dimethylammonio) acetate 1-(myristyl dimethylammonio) propane-3-sulfonate, and 1-(myristyldimethylammonio)-2-hydroxypropane-3-sulfonate.

The polar nonionic detergents are those in which the hydrophilic group containes a semi-polar bond directly between two atoms, for example, N→O, P→O, As→O, and S→O. There is charge separation between the two directly bonded atoms, but the detergent molecule bears no net charge and does not dissociate into ions.

The polar nonionic detergents of this invention include open-chain aliphatic amine oxides of the general formula $R_1R_2R_3N \rightarrow O$. For the purpose of this invention $R_1$ is an alkyl, alkenyl, or monohydroxyalkyl radical having about 10 to 16 carbon atoms, $R_2$ and $R_3$ are each selected from the group consisting of methyl, ethyl, propyl, ethanol, and propanol radicals.

Other operable polar nonionic detergents are the open-chain aliphatic phosphine oxides having the general formula $R_1R_2R_3P \rightarrow O$ wherein $R_1$ is an alkyl, alkenyl, or monohydroxyalkyl radical ranging in chain length from 10 to 18 carbon atoms, and $R_2$ and $R_3$ are each alkyl and monohydroxyalkyl radicals containing from 1 to 3 carbon atoms.

The aforementioned materials where employed, are generally included in amounts of about 0.05 to 0.30%, preferably about 0.01 to 0.2% by weight, based upon the weight of the sand.

The water when reused generally contains quantities of residual metal carbonate and bicarbonate, such as $NaHCO_3$ and $Na_2CO_3$. If desired, the water may be charged with $CO_2$ under slight pressure, at about 70° F., whereby additional quantities of $HCO_3$ are produced for future use in continuing the reaction, such as by carrying out the procedure on a continuous scale.

The following specific examples are given to further set forth the invention; it being understood that the same are by way of illustration only and are not to be construed as limiting the scope of the invention.

EXAMPLE 1

Into a suitable mixing vessel there are charged 100 cubic feet of sand and 200 cubic feet of water previously heated to about 95° F., and 2% $KHCO_3$ based upon the weight of the sand-water mixture. The slurry thus formed is gently mixed and an exothermic reaction is initiated bringing the temperature to 130° F. In about ½ hour, the temperatue begins to drop and there is formed three layers in the mixing vessel, the recovered tar forming the top layer, which is then withdrawn.

EXAMPLE 2

The procedure of example 1 is repeated except that the water layer is also withdrawn and charged with $CO_2$ under slight pressure and the thusly treated water recycled for another sand treatment.

EXAMPLE 3

The procedure of example 1 is repeated except that there is added to the sand ½% by weight of 1-(lauryl dimethylammonio-acetate).

EXAMPLE 4

The procedure of example 1 is repeated on a continuous scale with ¼ lb. of KHCO3 being added to the vessel for each 2,000 lbs. of fresh sand added thereto.

Since it is obvious that numerous changes and modifications can be made in the above-described details without departing from the spirit and nature of the invention, it is to be understood that all such changes and modifications are included within the scope of the invention.

I claim:

1. A process for the recovery of bituminous matter from tar sands comprising admixing said tar sands with water and 0.5–5% by weight of an alkali or alkaline earth metal bicarbonate salt, mixing the slurry thus produced and thereafter withdrawing said bituminous material extracted from said tar sands.

2. The process as defined in claim 1 wherein about 2 to 3 volumes of water is admixed with about 1 to 1½ volumes of tar sands.

3. The process as defined in claim 2 wherein 2 volumes of water are employed for each 1 volume of tar sands.

4. The process as defined in claim 1 wherein about 1.5 3.0% by weight of said salt is employed.

5. The process as defined in claim 1 wherein about 1/16–¾ lbs. of said salt is employed for each 1500–2500 lbs. of tar sands.

6. The process as defined in claim 1 wherein said tar sands contain about 6–15% by weight of said bituminous matter.

7. The process as defined in claim 1 wherein said salt is an alkali metal bicarbonate.

8. The process as defined in claim 1 wherein said water is preheated to about 85°–95° F.

9. The process as defined in claim 1 wherein said slurry is mixed without the formation of a vortex therein.

10. The process as defined in claim 1 wherein said mixing is carried out until said slurry reaches a temperature of about 100° to 130° F.

11. The process as defined in claim 1 wherein said mixing is carried out for about 15–90 minutes.

12. The process as defined in claim 1 wherein said mixing is carried out until three dicernable layers of bituminous material, water and sand are formed.

13. The process as defined in claim 1 carried out on a continuous scale.

14. The process as defined in claim 1 wherein there is added to said tar sands and water about 0.05 to 0.30% by weight of a neutral wetting agent.

15. The process as defined in claim 1 wherein external heat is applied to said vessel during said mixing.

16. The process as defined in claim 13 wherein said water is removed and charged with $CO_2$ for recirculation back into said process.

* * * * *